US007165748B2

(12) United States Patent
Ebuchi et al.

(10) Patent No.: US 7,165,748 B2
(45) Date of Patent: Jan. 23, 2007

(54) TRAIN POSITION DETECTION SYSTEM

(75) Inventors: Tomohiro Ebuchi, Hitachinaka (JP); Dai Watanabe, Hitachi (JP); Hiroshi Taoka, Hitachinaka (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 11/087,517

(22) Filed: Mar. 24, 2005

(65) Prior Publication Data

US 2005/0279891 A1 Dec. 22, 2005

(30) Foreign Application Priority Data

Jun. 16, 2004 (JP) ..... 2004-178115

(51) Int. Cl.
*B61L 25/00* (2006.01)

(52) U.S. Cl. ..... 246/122 R

(58) Field of Classification Search ..... 246/5, 246/122 R, 182 B; 701/19, 20, 207; 340/988
See application file for complete search history.

(56) References Cited

U.S. PATENT DOCUMENTS 4,863,123 A * 9/1989 Bernard et al. ..... 246/122 R
4,864,306 A 9/1989 Wiita
5,893,043 A 4/1999 Moehlenbrink
2005/0001741 A1 1/2005 Amiya et al.

FOREIGN PATENT DOCUMENTS

EP 0 825 418 2/1998
JP 2000-121658 4/2000

OTHER PUBLICATIONS

U.S. Appl. No. 10/919,211, filed Aug. 2004, Watanabe.

* cited by examiner

*Primary Examiner*—Mark T. Le
(74) *Attorney, Agent, or Firm*—Antonelli, Terry, Stout and Kraus, LLP.

(57) ABSTRACT

A train position detection system which enables train position detection based on a combination of passing information obtained when a train passes over a point at which a ground marker is installed and position information about the ground marker stored in an onboard device. The onboard device, a ground marker receiver and a track digital telegram receiver are mounted on a train. A ground marker that transmits passing information to the onboard device is provided on a track circuit, and a ground device that transmits a track digital telegram containing position information about the ground marker (marker position information) to the onboard device is provided. The onboard device stores the marker position information contained in the track digital telegram, and the position of the train is determined based on the passing information transmitted from the ground marker and the position information about the ground marker stored in the onboard device.

4 Claims, 2 Drawing Sheets

TRAIN POSITION DETECTION SYSTEM

CROSS REFERENCE TO RELATED APPLICATIONS

This application is with U.S. application Ser. No. 10/664,905, filed Sep. 22, 2003, now U.S. Pat. No. 7,006,012, and published as Publication No. US 2005-0001741 A1, and U.S. application Ser. No. 10/919,211, filed Aug. 16, 2004, and published as Publication No. US 2005-0137760.

The present application is based on and claims priority of Japanese patent application No. 2004-178115 filed on Jun. 16, 2004, the entire contents of which are hereby incorporated by reference.

BACKGROUND OF THE INVENTION

1. Field of the Invention

The present invention relates to a train position detection system that detects the position of a train in a particular section in which the train exists.

2. Description of the Related Art

Position detection means based on the number of axle revolutions detected by an electric tachometer, which is used in the automatic train control system (ATC: see Non Patent Document 1), may suffer errors in train position detection due to slipping or idling of a wheel. Such position detection means preferably has a measure to correct the detection error. For example, in train position detection based on the axle speed determined from the wheel revolution, in order that the train position can be accurately detected based on the speed output of an acceleration detection device when a wheel runs idle, there has been proposed a train position detection device comprising: an information processing device having a position/speed calculation section, an idling/slipping detection section and an acceleration correction section; a number-of-axle-revolutions detection device; a speed conversion processing device; absolute position correction means; and an acceleration detection device, in which, based on a speed output from the speed conversion processing device, an acceleration output from the acceleration correction section and an idling/slipping determination output from the idling/slipping detection section, the train position is determined from the acceleration output when an idling/slipping occurs, the train position is determined from the speed output when no idling/slipping occurs, and the train position is corrected using an absolute position when the absolute position is input from the absolute position correction means for receiving information of the transponder installed on the ground railway track (see Patent Document 1, for example).

Such a technique requires a transponder capable of transmitting a telegram indicating the absolute position to be installed on the railway track and cannot be applied to a system having no transponder, such as the ATS-S system. That is, in order to apply the technique, a transponder has to be additionally installed.

[Patent Document]1

Japanese Patent Laid-Open No. 2000-121658

[Non Patent Document]1

"Introduction to Signal Technology for Railway Engineers, ATS/ATC (revised edition)", Railway Electrical Engineering Association of Japan, 2001

SUMMARY OF THE INVENTION

An object of the present invention is to provide a train position detection system that can detect the position of a train using a ground marker of a conventional system when the train passes through a point rather than using a dedicated ground coil that transmits position information required for an onboard device to recognize the position of the train and a dedicated onboard coil for receiving the position information from the dedicated ground coil.

In order to attain the object, the present invention provides a system that detects the position of a train using a combination of a ground marker capable of transmitting point passing information to an onboard device and equipment capable of transmitting multiple-bit information to an onboard device of a train existing in a particular section.

Specifically, according to the present invention, there is provided a train position detection system for an onboard device of a train to recognize the absolute position of the train, comprising: ground signaling equipment having, in a section in which the train travels, a ground marker that transmits point passage information to the onboard device passing over the installation point of the ground marker and a ground device capable of transmitting a telegram containing multiple-bit information to the section; and the onboard device having means of recognizing the point passing information from the ground marker and means of receiving the telegram containing multiple-bit information transmitted from the ground device and storing the content of the telegram, characterized in that the ground device transmits, to the section, the telegram containing multiple-bit information indicating the absolute position of the ground marker in the section, and the onboard device receives the telegram when the train with the onboard device mounted thereon is traveling in the section and stores the absolute position of the ground marker in the section, and in response to the point passing information, which serves as a trigger, received when the train passes over the ground marker, the onboard device recognizes the absolute position of the ground marker in the section as the absolute position of the train.

According to the present invention, the train position detection system described above is further characterized in that the ground signaling equipment has a plurality of ground markers in one section, the telegram transmitted by the ground device to the section contains multiple-bit information indicating the absolute positions of the ground markers located in the section, the onboard device has means of storing the absolute positions of the plurality of ground markers contained in the telegram and the number of times that the onboard device has passed over ground markers, and when the train with the onboard device mounted thereon passes over a ground marker and receives the triggering point passing information, the number of times that the onboard device has passed over ground markers is updated, and at the same time, the absolute position information about the ground marker over which the train has just passed is selected based on the stored position information about the plurality of ground markers and the updated number of times that the onboard device has passed over ground markers, and the selected absolute position information is recognized as the absolute position of the train.

According to the present invention, in a railway section in which a ground marker capable of transmitting point passing information to an onboard device and equipment capable of transmitting multiple-bit information to the onboard device on a train existing in the particular section have been already provided, the train position detection can be accomplished without the need of additionally providing a dedicated ground coil for transmitting position information and a dedicated onboard coil for receiving the position information from the dedicated ground coil.

DETAILED DESCRIPTION OF THE PREFERRED EMBODIMENTS

According to the present invention, a train position detection system that can accomplish train position detection without the need of a dedicated ground coil (transponder) for transmitting point information and a dedicated onboard coil for receiving the point information from the dedicated ground coil comprises: a ground marker receiver, a digital telegram receiver and an onboard device mounted on a train; a ground marker provided on a track and capable of transmitting point passing information to the onboard device; and a ground device that transmits a digital telegram containing the position information about the ground marker to the train existing in a particular section of the track, and the onboard device determines the position of the train from the point passing information from the ground marker and the ground marker position information contained in the digital telegram.

Embodiment 1

Figure 1:
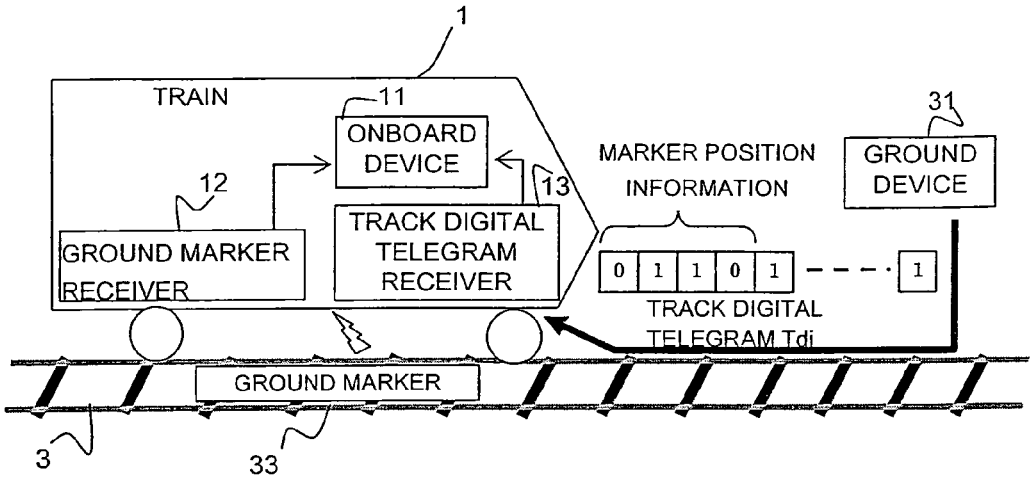
FIG. 1 is a schematic diagram showing a train position detection system according to a first embodiment of the present invention.

With reference to FIG. 1, an arrangement of a train position detection system according to a first embodiment of the present invention will be described. This embodiment is an example in which the present invention is applied to a track circuit system in which a ground marker 33 capable of transmitting point passing information to an onboard device is provided on a track circuit 3, and a ground device 31 transmits an ATC track digital telegram Tdi through the track circuit 3.

A train 1 has an onboard device 11, a ground marker receiver 12 and a track digital telegram receiver 13 mounted thereon. The ground device 31 that transmits a track digital telegram Tdi to the track circuit 3 and the ground marker 33 are provided on the track circuit 3. The ground device 31 is a device that transmits, to the track circuit 3, a track digital telegram Tdi containing bit information including position information about the ground marker 33 located in the section of the track circuit 3 (marker position information). The ground marker 33 is means to give point passing information to the ground marker receiver 12 on the train 1.

The onboard device 11 is means to store the position information about the ground marker 33 contained in the track digital telegram Tdi received at the track digital telegram receiver 13 when the train 1 exists on the track circuit 3. Besides, the onboard device 11 serves also to accomplish position detection of the train 1 by recognizing the position information about the ground marker 33 stored therein as the on-track position of the train 1 in response to the ground marker receiver 12 receiving the point passing information when the train 1 is passing directly above the ground marker 33. The ground marker receiver 12 is means to receive point passing information when it lies directly above the ground marker 33. The track digital telegram receiver 13 is means to receive a track digital telegram Tdi transmitted from the ground device 31 to the track circuit 3 when the train 1 exists on the track circuit 3.

According to this embodiment, once the train 1 moves into the section of the track circuit 3, the track digital telegram receiver 13 receives the track digital telegram Tdi containing the ground marker position information via the track circuit 3, retrieves the ground marker position information from the track digital telegram Tdi and stores the same in storage means (not shown). Then, when the train passes over the ground marker 33, and the ground marker receiver 12 receives the point passing information, the stored marker position information is recognized as the on-track position of the train 1. In this way, in the system in which the track digital telegram Tdi is transmitted through the track circuit 3 provided with the ground marker 33, by containing the marker position information in the track digital telegram Tdi, the detection of the on-track position of the train can be accomplished without any additional devices.

Embodiment 2

Figure 2:
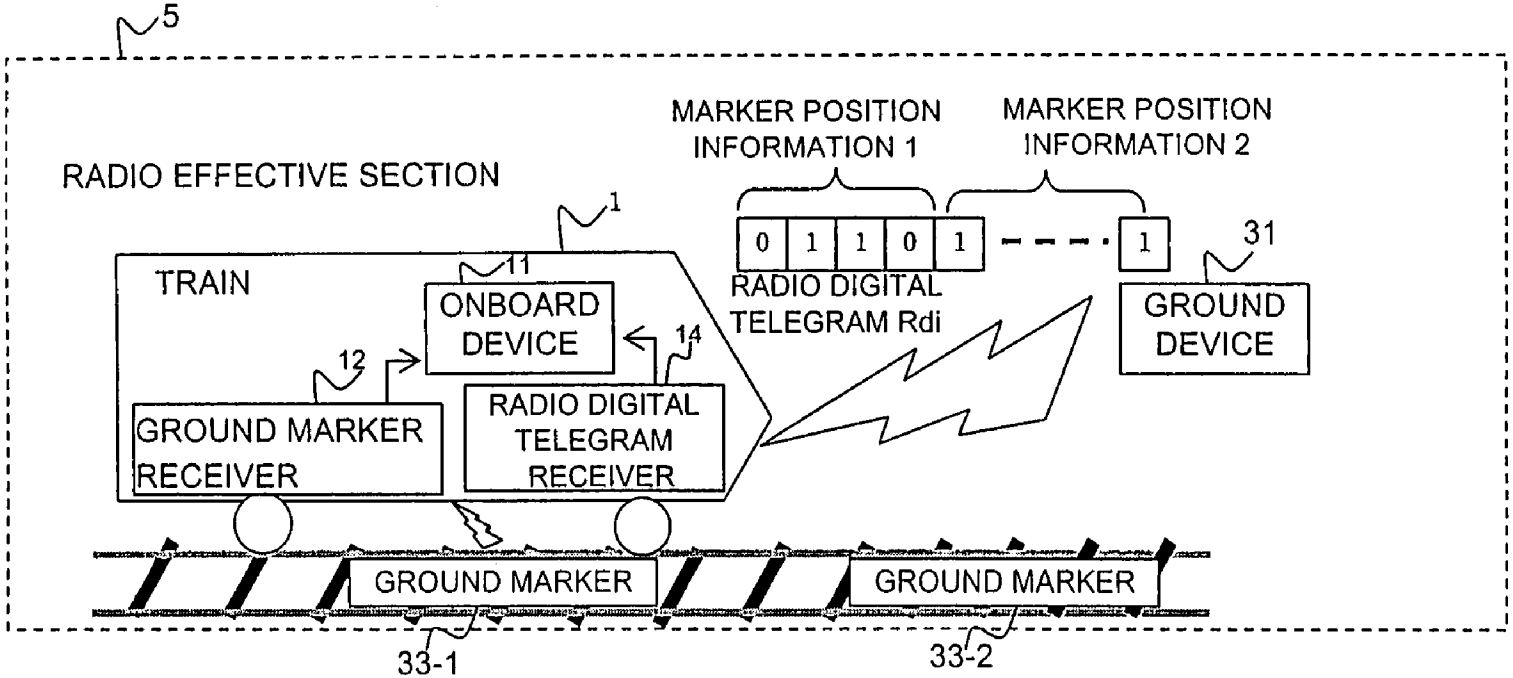
FIG. 2 is a schematic diagram showing a train position detection system according to a second embodiment of the present invention.

With reference to FIG. 2, an arrangement of a train position detection system according to a second embodiment of the present invention. This embodiment is an example in which the digital telegram, which is transmitted to the train 1 via the track circuit 3 according to the first embodiment, is transmitted to the train 1 by radio. The train 1 has an onboard device 11, a ground marker receiver 12 and a radio digital telegram receiver 14 mounted thereon.

The onboard device 11 has: a capability of storing plural pieces of position information about plural ground markers 33 contained in a radio digital telegram Rdi received at the radio digital telegram receiver 14 when the train exists in a radio effective section 5; a capability of storing the number of times that the train 1 has passed over ground markers 33 in the radio effective section 5 (that is, a number-of-times-of-passage counter); a capability of accomplishing the train position detection by, in response to the train 1 passing directly above an n-th ground marker 33 in the radio effective section and the ground marker receiver 12 receiving the point passing information therefrom, recognizing one, concerning the n-th ground marker 33, of the stored plural pieces of position about plural ground markers 33 as the on-track position of the train 1; and a capability of incrementing the number of times that the train 1 has passed over ground markers 33 in the radio effective section 5 by 1at the same time as the train 1 accomplishes the position detection.

The ground marker receiver 12 is means to receive point passing information when it lies directly above the ground marker 33. The radio digital telegram receiver 14 is means to receive a radio digital telegram Rdi transmitted from the ground device 31 to the radio effective section 5 when the train 1 exists in the radio effective section 5. According to this embodiment, the radio digital telegram Rdi contains position information about plural ground markers 33 provided in the radio effective section 5.

The ground device 31 is a device that transmits radio digital telegram Rdi containing bit information including plural pieces of position information about plural ground markers 33 provided in the radio effective section 5.

The radio digital telegram receiver 14 receives the radio digital telegram Rdi transmitted from the ground device 31 to the radio effective section 5 when the train 1 exists in the radio effective section 5. The onboard device 11 clears the number of times that the train 1 has passed over ground markers 33 in the radio effective section 5 when the train moves into a new radio effective section 5. In addition, the onboard device 11 stores plural pieces of position information about plural ground markers 33 contained in the radio digital telegram Rdi received at the radio digital telegram receiver 14 when the train 1 exist in the radio effective section 5. Furthermore, the onboard device 11 accomplishes the train position detection by, in response to the train 1 passing directly above an n-th ground marker 33 in the radio effective section and the ground marker receiver 12 receiving the point passing information therefrom, recognizing one, concerning the n-th ground marker 33, of the stored plural pieces of position about plural ground markers 33 as the on-track position of the train 1. And at the same time as accomplishing the position detection, the onboard device 11 increments the number of times that the train 1 has passed over ground markers 33 in the radio effective section 5 by 1.

According to this embodiment, when the train 1 moves into the radio effective section 5 of the track circuit 3, the radio digital telegram receiver 14 receives the radio digital telegram Rdi containing plural pieces of marker position information about plural ground markers located in the radio effective section, and the plural pieces of ground marker position information are retrieved from the radio digital telegram Rdi and stored in storage means (not shown), the number-of-times-of-passage counter is cleared. Then, when the train passes over a first ground marker 33-1 and the ground marker receiver 12 receives the point passing information, the number-of-times-of-passage counter is incremented by 1, and first marker position information of the stored plural pieces of ground marker position information is recognized as the on-track position of the train 1. Then, when the train passes over a second ground marker 33-2 and the ground marker receiver 12 receives the point passing information, the number-of-times-of-passage counter is incremented by 1, and twelfth marker position information of the stored plural pieces of ground marker position information is recognized as the on-track position of the train 1. In this way, in the system in which ground markers 33 are provided on the track, and the radio digital telegram Rdi containing plural pieces of marker position information is transmitted, the on-track position of the train can be detected without any additional devices.

As described above, the present invention can be applied to position detection means based on the number of axle-revolutions detected by an electric tachometer used in the automatic train control system as means for correcting an error of the detected train position caused by slipping, idling or the like of wheels.

What is claimed is:

1. A train position detection system for an onboard device of a train to recognize the absolute position of the train, comprising:

ground signaling equipment having, in a section of a track on which said train travels, a ground marker that transmits point passage information to the onboard device passing over the installation point of said ground marker and a ground device capable of transmitting a telegram containing multiple-bit information to said section of said track; and the onboard device having means of recognizing the point passing information from said ground marker and means of receiving said telegram containing multiple-bit information transmitted from said ground device and storing the content of said telegram, characterized in that said ground device transmits, to said section, said telegram containing multiple-bit information indicating the absolute position of said ground marker in said section, and said onboard device receives said telegram when said train with said onboard device mounted thereon is traveling in said section and stores the absolute position of said ground marker in said section, and in response to said point passing information, which serves as a trigger, received when said means of recognizing the point passing information lies directly above said ground marker and said train passes directly above said ground marker, said onboard device recognizes the absolute position of said ground marker in said section of said track as the absolute position of said train.

2. The train position detection system according to claim 1, characterized in that said ground signaling equipment has a plurality of ground markers in one section, said telegram transmitted by said ground device to said section contains multiple-bit information indicating the absolute positions of said ground markers located in said section, said onboard device has means of storing the absolute positions of said plurality of ground markers contained in said telegram and the number of times that said onboard device has passed over ground markers, and when said train with said onboard device mounted thereon passes over respective one of said ground markers and receives the triggering point passing information, the number of times that said onboard device has passed over ground markers is updated, and at the same time, the absolute position information about said ground marker over which said train has just passed is selected based on said stored position information about said plurality of ground markers and said updated number of times that the said onboard device has passed over ground markers, and the selected absolute position information is recognized as the absolute position of said train.

3. The train position detection system according to claim 1, wherein said section of said track is one of plural sections of said track and is said one section on which said train presently travels.

4. The train position detection system according to claim 2, wherein said section of said track is one of plural sections of said track and is said one section on which said train presently travels.

* * * * *